US005511666A

United States Patent [19]

Grip

[11] Patent Number: 5,511,666

[45] Date of Patent: Apr. 30, 1996

[54] SALES PROMOTION AID

[76] Inventor: Peter S. Grip, 40 Masters Dr., Southington, Conn. 06489

[21] Appl. No.: 247,692

[22] Filed: May 23, 1994

[51] Int. Cl.[6] ..... B65D 69/00

[52] U.S. Cl. ..... 206/579; 206/315.9; 220/504

[58] Field of Search ..... 206/579, 575, 206/315.9; 220/503, 504, 528, 554

[56] References Cited

U.S. PATENT DOCUMENTS

| | | | |
|---|---|---|---|
| 1,013,775 | 1/1912 | Hoffman | 220/503 |
| 1,919,198 | 7/1933 | Burnet | 206/579 |
| 3,052,246 | 9/1962 | Beard | 220/504 |
| 4,042,156 | 8/1977 | Knight | 206/315.9 |
| 5,139,189 | 8/1992 | Hanley | 206/315.9 |
| 5,292,161 | 3/1994 | Green | 206/315.9 |

FOREIGN PATENT DOCUMENTS

| | | | |
|---|---|---|---|
| 2127376 | 4/1984 | United Kingdom | 220/504 |

*Primary Examiner*—David T. Fidei
*Attorney, Agent, or Firm*—Richard A. Craig

[57] ABSTRACT

A sales promotion aid is a package including a tube having first and second ends and first and second compartments. The first compartment extends from the first end toward the second end and the second compartment extends from the second end toward the first end. A third compartment is located between the first and second compartments, and the compartments contain items related to or useful in pursuing or enjoying a common purpose, such as the game of golf. The compartments are aligned with each other.

19 Claims, 1 Drawing Sheet

SALES PROMOTION AID

BACKGROUND OF THE INVENTION

This invention relates to a sales promotion aid and more particularly to such an aid in the form of a display package containing a plurality of different items that are related to or useful in the pursuit or enjoyment of a common purpose or activity. One such common purpose is the game of golf, and among the items that may be included in such package are golf balls, tees, divot tools and soft or hard beverages.

An important object of the invention is to provide a sales promotion aid in the form of a package containing and displaying for sale a golf ball and at least one other item having to do with the pursuit or enjoyment of golf, such as tees and divot tools. Other important objects of the invention are to: (1) promote sales of the packaged items without causing psychological pressure on customers; (2) provide a selling system that is appropriate for a variety of items; (3) enhance customer appreciation of the value of goods from their attractive, aesthetically pleasing appearance in the package display; (4) reduce tedious wrapping work; (5) promote appreciation of customers and donees of the inventive package as a good gift; and (6) deter shoplifting of items that are in the package.

To attain the foregoing and other objects and advantages, the invention presents a package containing and displaying for sale a golf ball and at least one other item that is of interest to a golfer, the package being tube-like or box-like and having an inner space large enough to hold the golf ball(s) and tees and/or other golf item(s) with 360 degree viewing of the packaged items. Decorative or plain inserts are in the package in position to improve the aesthetics and hold the packaged golf ball(s) in the packaged golf balls in place with their logos exposed to view. Other items such as tees and divot tools are insertable into the surface of the inserts and closures are provided to hold all elements of the package in place.

Customers and donees have a good view of the packaged items through transparent or translucent walls or at least a good understanding of the contents of the package from identification indicia on printed graphics, all of which provides a most interesting and aesthetically pleasing look.

The foregoing and other objects and advantages of the invention will be clearly understood from the following description of preferred embodiments of the invention and the accompanying drawing of such embodiments.

SUMMARY OF THE INVENTION

The invention presents a sales promotion aid in the form of a display package that includes a tube with first and second ends and first, second and third compartments. The first compartment extends from the first end toward the second end, the second compartment extends from the second end toward the first end, and the third compartment is between the first and second compartments. The aid also includes means closing the first and second ends of the tube, means providing a first partition between the first and third compartments and means providing a second partition between the second and third compartments. The compartments contain and display items related to and useful in pursuing or enjoying a common purpose. The items are disclosed as including first and second golf balls in the first and second compartments and a plurality of tees in the third compartment.

The tube has an internal configuration defining a cylinder of a diameter substantially equal to the diameter of the golf balls. For balls used in the U.S., the diameter is about 1.68 inches (4.28 cm).

In one preferred embodiment, the interior configuration coincides with the cylinder, whereas in other preferred embodiments the cylinder is defined by a regular polygon modified to have rounded corners. Forms are disclosed wherein the regular polygon is a square and wherein the regular polygon is an equilateral triangle.

The tube may be transparent or translucent to permit viewing of items within the tube. Or, the tube may be opaque, in which case the tube may be provided with indicia identifying the contents of the package.

The means closing the first end of the tube is a closure that provides a bottom of the package and the means that closes the second end of the tube is provided by a closure that is a top of the package. The means providing the first partition is a pad holder and the means providing the second partition is a pad insert. The pad holder has a plurality of apertures with open ends facing the second compartment. The tees are held by the apertures with their enlarged ends projecting from the pad holder toward and into the second compartment.

If used, the indicia identifying the contents of the package may be supplied by a label located at a position corresponding to the first partition.

The manner in which the invention attains the foregoing objects and advantages will appear more clearly from the following description and the accompanying drawing.

DESCRIPTION OF THE INVENTION

Figure 1:
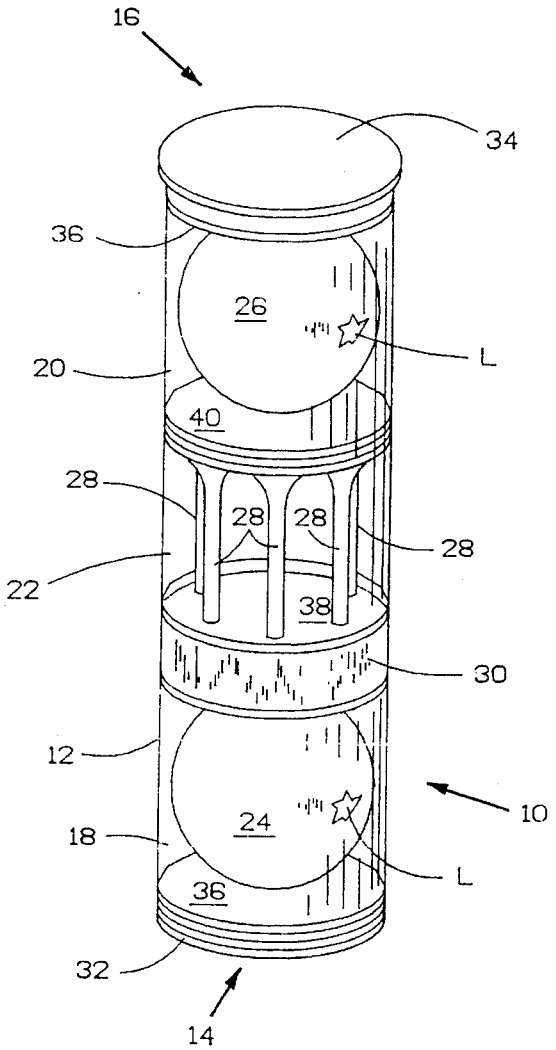
FIG. 1 is a perspective view of a display package that is a preferred embodiment of the invention.

FIG. 1 is a perspective view of a display package 10 that is a first preferred embodiment of the invention and is a sales promotion aid that displays for sale in an attractive manner a plurality of items useful in the pursuit or enjoyment of a common purpose, such as golf. Package 10 includes a onepiece tube 12 having a lower or first end 14, an upper or second end 16, a first or lower compartment 18, a second or upper compartment 20 and a third or middle compartment 22. Compartment 18 extends from first end 14 toward second end 16, second compartment 20 extends from second end 16 toward first end 14 and third compartment 22 is a middle compartment located between first and second compartments 18 and 20. Middle (third) compartment 22 is not only between but is adjacent compartments 18 and 20.

Aid 10 also includes means closing ends 14 and 16, means providing a first partition between first and third compartments 18 and 22 and means providing a second partition between second and third compartments 20 and 22.

The displayed items include a first golf ball 24 in first compartment 18, a second golf ball 26 in second compartment 20 and a plurality (say nine) of golf tees 28 in third compartment 22.

Figure 2:
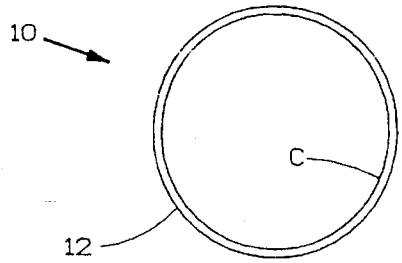
FIG. 2 is an end view of the tube of the package of FIG. 1.

Tube 12 has an interior configuration defining a cylinder indicated at C in FIG. 2 having a diameter substantially equal to the diameter of golf balls 24 and 26. For balls used in the U.S., this diameter is about 1.68 inches (4.28 cm).

Figure 3:
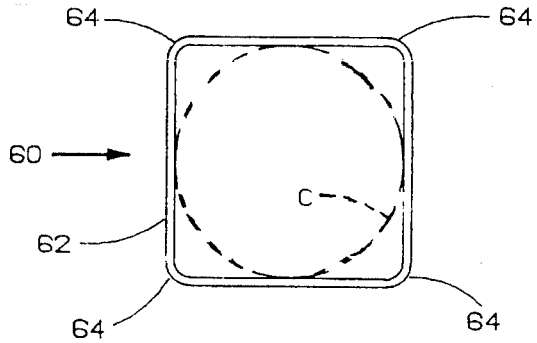
FIG. 3 is an end view of a tube of a display package that is a second embodiment of the invention.
Figure 4:
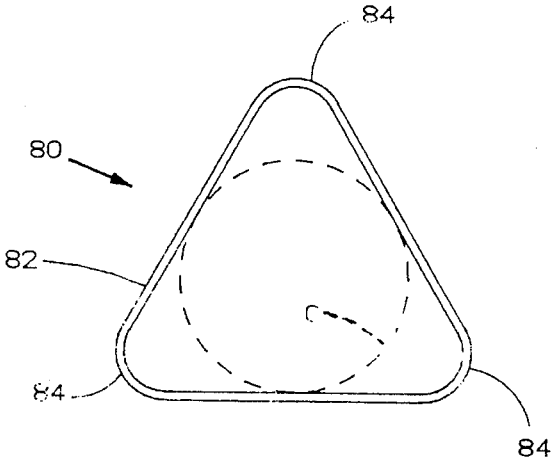
FIG. 4 is an end view of a tube of a display package that is a third embodiment of the invention.

In the preferred embodiment of the invention shown in FIG. 1, the interior configuration of tube 12 coincides with cylinder C, whereas the other preferred embodiments shown in FIG. 3 and FIG. 4 entail defining cylinder C by a regular polygon, the sides of which are tangential to cylinder C.

The embodiment of FIG. 3 comprises a tube 60 with the configuration of a square 62 the four sides of which define cylinder C by being tangential thereto.

The embodiment of FIG. 4 comprises a tube 80 with the configuration of an equilateral triangle 82 the three sides of which define cylinder C by being tangential thereto.

Cylinder C has the same diameter in each of FIGS. 2, 3 and 4.

The corners of the regular polygons shown in FIGS. 3 and 4 are smoothly convexly rounded as seen in FIG. 3 at 64 and in FIG. 4 at 84.

Tubes 12, 62 and 82 may be transparent or translucent, so the contents can be viewed. Tubes 12, 62 and/or 82 may be opaque, in which case such contents will not be seen, but may be given by indicia on a label 30 adhered to the exterior of tube 12, 62 or 82. If used, label 30 may be located at a position corresponding to the relatively wide (vertically) space between compartments 18 and 22.

Because of the diameter of cylinder C, tube 12, 62 or 82 receives and more or less snugly holds golf balls 24 and 26 in their compartments 18 and 20 with their logos L visible.

The means closing end 14 of tube 12 is a seal or closure type base 32 and the means closing end 16 of tube 12 is provided by inserts 34. Additional closures are provided as and if needed to hold all elements of package 10 in place. A pad insert 36 may be positioned inside tube 12, resting on base 32. In any event, golf ball 24 is inserted into end 16 of tube 12 and moved therein by gravity or otherwise until it encounters and rests upon insert 36 or base 32.

The pointed ends of tees 28 are inserted into a pad holder 38 such that tees 28 are parallel and uniformly spaced from each other, and arranged in a circle, and having their enlarged (golf ball holding) ends uniformly spaced from pad holder 38. The assembly of pad holder 38 and tees 28 is inserted into end 16 of tube 12, with pad holder 38 facing golf ball 24, until pad holder 38 rests on golf ball 24.

Another pad insert 40 is then inserted into end 16 of tube 12 and is cause to rest on the enlarged ends of tees 28, after which ball 26 is inserted into end 16 of tube 12 to engage and rest on insert 40. Closure 34 with insert 36 inserted thereinto is inserted into end 16 of tube 12 to complete package 10 and to help keep the contents of tube 12 from shifting position.

Golf balls 24 and 26 are in compartments 18 and 20, respectively, and golf tees 28 are in compartment 22. Also, it will be seen that the means closing ends 14 and 16 of tube 12 are provided by seal type base 32 and insert 34. Pad holder 38 is the means providing the first partition (between compartments 18 and 22) and the means providing the second partition (between compartments 20 and 22) is pad insert 40.

The means described in the immediately preceding four paragraphs as applying to tube 12 apply also to tubes 62 and 82.

It is believed that the manner in which the invention achieves the above stated objects and advantages will be appreciated from the foregoing description of the invention.

The disclosed details are exemplary only and are not to be taken as limitations on the invention except as those details may be included in the appended claims.

What is claimed is:

1. A sales promotion aid comprising a package including a tube having first and second ends and first and second compartments, said first compartment extending from said first end toward said second end and said second compartment extending from said second end toward said first end, said compartments containing items related to or useful in pursuing or enjoying a common purpose, said aid further comprising a third compartment between and adjacent said first and second compartments and containing an item related to or useful in pursuing or enjoying the common purpose, and means for closing said first and second ends of said tube, means providing a first partition between said first and third compartments, and means for providing a second partition between said second and third compartments, wherein said items include a first golf ball in said first compartment and a second golf ball in said second compartment.

2. An aid according to claim 1 wherein said items include a plurality of golf tees in said third compartment.

3. An aid according to claim 1 wherein said tube has an interior configuration defining a cylinder having a diameter substantially equal to the diameter of said balls.

4. An aid according to claim 3 wherein said diameter is about 1.68 inches (4.28 cm).

5. An aid according to claim 3 wherein said interior configuration coincides with said cylinder.

6. An aid according to claim 3 wherein said cylinder is defined by a regular polygon.

7. An aid according to claim 6 wherein said polygon has rounded corners.

8. An aid according to claim 7 wherein said polygon is a square.

9. An aid according to claim 7 wherein said polygon is an equilateral triangle.

10. An aid according to claim 1 wherein said tube is transparent or translucent.

11. An aid according to claim 1 wherein said tube is opaque and has displayed indicia identifying said items.

12. An aid according to claim 1 wherein said means for closing said first end of said tube is a closure that provides a bottom of said package and said means for closing said second end of said tube is a closure that provides a top of said package.

13. An aid according to claim 12 wherein said means for providing said first partition is a pad holder and said means for providing said second partition is a pad insert.

14. An aid according to claim 13 wherein said items include a first golf ball in said first compartment, a second golf ball in said second compartment and a plurality of golf tees in said third compartment, and wherein said pad holder has a plurality of apertures with open ends facing said second compartment and said tees are held by said apertures with their enlarged ends facing said second compartment.

15. An aid according to claim 14 further including a label applied to the outer surface of said tube and identifying the contents of said tube.

16. An aid according to claim 15 wherein said label is located between said first and third compartments, at the location of said first partition.

17. An aid according to claim 2 wherein said items include a golf tee in said third compartment.

18. An aid according to claim 2 wherein said items include nine golf tees in said third compartment.

19. A sales promotion aid comprising a package including a onepiece tube having first and second ends and first, second and third aligned compartments of substantially the same size, said first compartment extending from said first end toward said second end, said second compartment extending from said second end toward said first end and said third compartment being between said first and second compartments, said compartments containing items useful in pursuing or enjoying a common purpose, and means providing a partition between each said compartment and at least one other said compartment.

* * * * *